US008502439B2

(12) United States Patent
Stange

(10) Patent No.: US 8,502,439 B2
(45) Date of Patent: Aug. 6, 2013

(54) ELECTRODE FOR A DISCHARGE LAMP AND CORRESPONDING PRODUCTION METHOD

(75) Inventor: Markus Stange, Berlin (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 167 days.

(21) Appl. No.: 13/062,675

(22) PCT Filed: Sep. 5, 2008

(86) PCT No.: PCT/EP2008/061728

§ 371 (c)(1),
(2), (4) Date: Mar. 7, 2011

(87) PCT Pub. No.: WO2010/025769

PCT Pub. Date: Mar. 11, 2010

(65) Prior Publication Data

US 2011/0163655 A1 Jul. 7, 2011

(51) Int. Cl.
*H01J 1/00* (2006.01)
*H01J 9/02* (2006.01)

(52) U.S. Cl.
USPC ..... 313/311; 313/326; 445/46

(58) Field of Classification Search
USPC ..... 313/623–625, 634–636, 493, 318.12, 313/570, 578; 118/50; 445/26, 27
See application file for complete search history.

(56) References Cited

U.S. PATENT DOCUMENTS

| | | | |
|---|---|---|---|
| 4,950,954 | A | 8/1990 | Passmore et al. |
| 2003/1002039 | | 1/2003 | Kitahara |
| 2006/0208635 | A1 | 9/2006 | Lenef et al. |
| 2007/0182332 | A1 | 8/2007 | Haacke et al. |

FOREIGN PATENT DOCUMENTS

| | | | |
|---|---|---|---|
| EP | 1 763 065 | | 3/2007 |
| JP | 57 043352 | | 3/1982 |
| JP | 57043352 | A * | 3/1982 |
| JP | 2002-083538 | | 3/2002 |
| JP | 2003-203602 | | 7/2003 |
| JP | 2007-188802 | | 7/2007 |

* cited by examiner

*Primary Examiner* — Anh Mai
*Assistant Examiner* — Elmito Breval
(74) *Attorney, Agent, or Firm* — Cozen O'Connor

(57) ABSTRACT

An electrode for a discharge lamp, wherein the electrode comprises a pin and a mass arranged on an end of the pin by melting over an electrode coil. The pin consists of tungsten with microstructure-stabilizing additives, wherein the concentration of the microstructure-stabilizing additives is greater than or equal to 30 ppm. The electrode coil consists of pure tungsten, which has additives at most up to a concentration of 20 ppm.

17 Claims, 2 Drawing Sheets

ELECTRODE FOR A DISCHARGE LAMP AND CORRESPONDING PRODUCTION METHOD

RELATED APPLICATIONS

This is a U.S. national stage of application No. PCT/EP2008/061728, filed on Sep. 5, 2008.

FIELD OF THE INVENTION

Technical Sphere

The present invention relates to an electrode for a discharge lamp, in particular a high-pressure discharge lamp, wherein the electrode comprises a pin and a mass arranged on an end of the pin by melting over an electrode coil, wherein the pin is composed of tungsten with microstructure-stablilizing additives. It further relates to a corresponding method for producing an electrode for a discharge lamp.

BACKGROUND OF THE INVENTION

FIG. 1 shows a thermally heavy-duty electrode known from the prior art, on the left before melting over the electrode coil, on the right after melting, in cross-section in each case, as used for example to achieve good maintenance with high-pressure discharge lamps. In this case high-purity tungsten is used both for the pin 12 and for the electrode coil 14, i.e. tungsten with additives, the concentration of which is less than or equal to 20 ppm. However, this results in the disadvantage of a low recrystallization temperature, as a result of which the electrodes very easily become brittle at higher temperatures, especially during operation of the lamp. Melting over an electrode coil in order to create a thermally compact mass 16 is already known from DE 1 170 542. Rejects resulting from the known brittleness are accepted, or are avoided by preventing impacts as much as possible during handling. Hence use for example as a car lamp is not possible with electrodes of this type.

FIG. 2 shows a further generic electrode known from the prior art, in which tungsten is used with microstructure-stablilizing additives, for example potassium, wherein the concentration of the additives both in the material used for the pin and the material used for the electrode coil is greater than or equal to 30 ppm. Although the brittleness is reduced, these additives have a negative impact on the service life of the lamp. Additionally, microstructure-stabilized electrode coils melt only with great difficulty, since the stabilizing addives result in the formation of cavities 18. At present such electrodes are used in applications with a high probability of impact, for example car lamps, and their service life restrictions are accepted.

SUMMARY OF THE INVENTION

One object of the present invention is to provide an electrode having optimally good maintenance and an optimally long lamp service life combined with maximum break strength. Another object is to provide a discharge lamp with such an electrode.

The above object can be achieved in accordance with an embodiment of the present invention if the pin is manufactured from microstructure-stabilized tungsten in order to provide the necessary break stength, and an electrode coil of maximally pure tungsten is used in order to facilitate melting without the formation of cavities, combined with good maintenance. If such an electrode coil and such a pin are used, an electrode is obtained that is characterized firstly by high break strength and secondly by good maintenance plus a long service life. Use in lamps subject to mechanical stress is possible without further ado.

Tungsten is regarded as sufficiently pure for the electrode coil if it has at most 20 ppm of additives, comprising both unwanted additives, i.e. contaminants, as well as functional additives. The concentration of additives for the electrode coil with less than or equal to 5 ppm is especially preferred, or even more preferably less than or equal to 1 ppm. As a result a break-proof electrode with a high-purity arc zone for arc discharge is provided, and thus a particularly good performance.

For sufficient microstructure-stabilization of the pin material, the tungsten used for this purpose is provided with microstructure-stabilizing additives. Potassium and/or thorium are particularly considered here. The concentration of the microstructure-stabilizing additives is at least 30 ppm, or better 60 ppm, or even better 80 ppm.

In the case of a first variant of an inventive electrode the pin extends into the melt zone of the electrode coil. This enables the melting process to be implemented only near the surface and/or with a low input of energy.

In another preferred variant the pin does not extend into the melt zone of the electrode coil. As a result it is ensured that the compact thermal mass which is formed by melting includes only very small portions of the pin and thus virtually no additives. The melting operation can be altered, in particular extended, to form a larger compact thermal mass, compared to the variant in which the pin extends into the melt zone of the electrode coil. A large compact thermal mass results in a particularly good performance of the electrode.

Preferably the pin does not extend into a front region of the electrode coil facing away from the pin. As a result it is ensured particularly simply that virtually no portions of the pin are contained in the compact thermal mass and thus ideally no additives are contained.

Preferably the electrode coil comprises between 3 and 20 windings, wherein the pin at least does not extend into the front quarter facing away from the pin, preferably not into the front third facing away from the pin, of the windings.

In this case the windings of the electrode coil can be arranged at least in part in one layer. However, the windings of the electrode coil can additionally or alternatively, i.e. at least in part, be arranged one above the other in at least two layers. Preferably the part of the electrode coil facing away from the pin is formed in one layer, and the part of the electrode coil facing the pin is formed in two or more layers. As a result the shape of the compact thermal mass can be influenced in simple manner.

Preferably the melting is designed such that a compact thermal mass is formed, wherein the portion of the pin in this compact thermal mass is less than or equal to 15%, preferably less than or equal to 1%.

The preferred embodiments proposed with reference to an inventive electrode and the advantages thereof apply correspondingly, where applicable, for the inventive method.

BRIEF DESCRIPTION OF THE DRAWINGS

In the following, exemplary embodiments of inventive electrodes are now described in greater detail with reference to the enclosed schematic drawings. These show.

DETAILED DESCRIPTION OF THE DRAWINGS

Figure 1A:
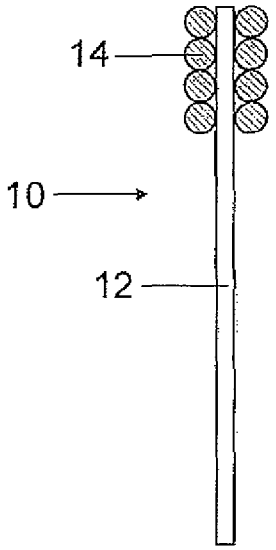
FIG 1a (Prior art)
FIG. 1*a* shows a first electrode, known from the prior art, before melting.
Figure 1B:
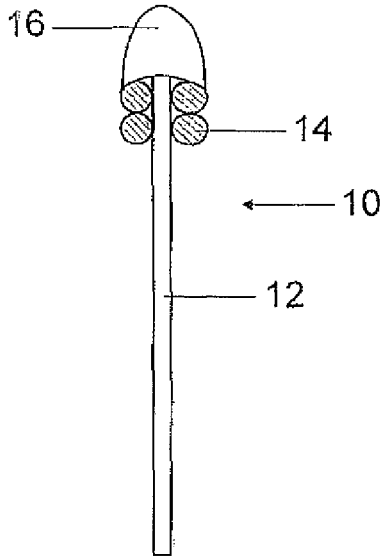
FIG 1b (Prior art)
FIG. 1*b* shows the first electrode after melting over the electrode coil, in each case in cross-section.
Figure 2A:
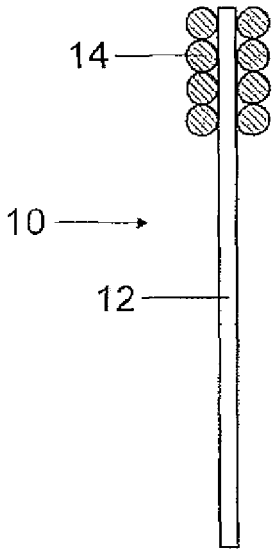
FIG 2a (Prior art)
FIG. 2*a* shows a second electrode known from the prior art, before melting.
Figure 2B:
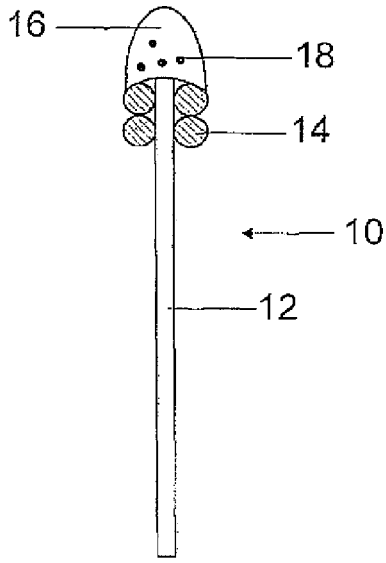
FIG 2b (Prior art)
FIG. 2*b* shows the second electrode after melting over the electrode coil, in each case in cross-section.
Figure 3A:
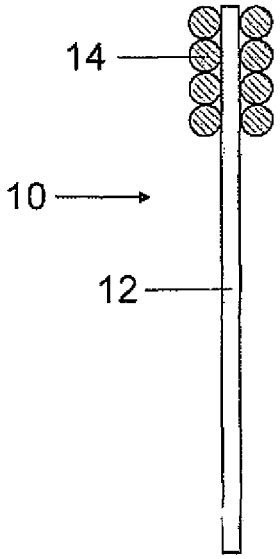
FIG. 3*a* shows an electrode in accordance with a first embodiment of the invention before melting and FIG. 3*b* shows this first embodiment after melting over the electrode coil, in each case in cross-section; and F*ig*. 4*a* shows an electrode in accordance with a second embodiment of the invention before melting.
Figure 3B:
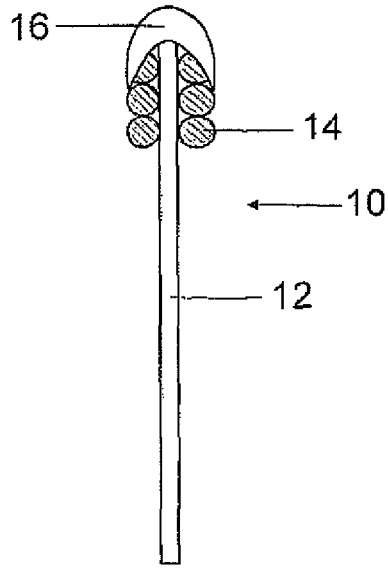

FIG. 3 shows a first embodiment of an inventive electrode 10. In the illustration in FIG. 3*a* it can be seen that the electrode coil 14 is arranged at the end of the pin 12, wherein the pin 12 projects completely through the electrode coil 14. Whereas the pin 12 consists of tungsten with microstructure-stabilizing additives, wherein the concentration of the additives is greater than or equal to 30 ppm, or better 60 ppm, or even better 80 ppm, the electrode coil 14 consists of pure tungsten, which has additives in a concentration of at most 20 ppm, preferably at most 5 ppm, even more preferably at most 1 ppm. From the illustration in FIG. 3*b* it can be seen how by melting over the electrode coil 14 a compact thermal mass 16 is created, which thereby forms a high-purity arc zone for the arc discharge.

Figure 4A:
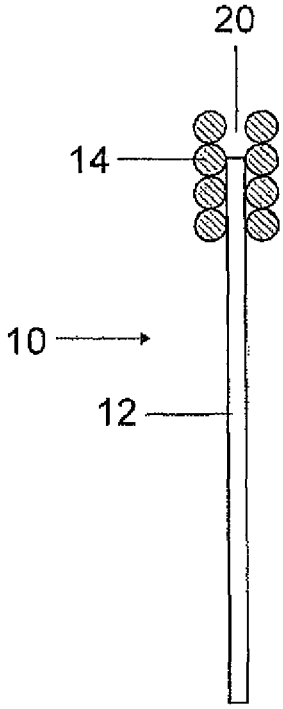
FIG. 4*b* shows this second embodiment after melting over the electrode coil, in each case in cross-section.
Figure 4B:
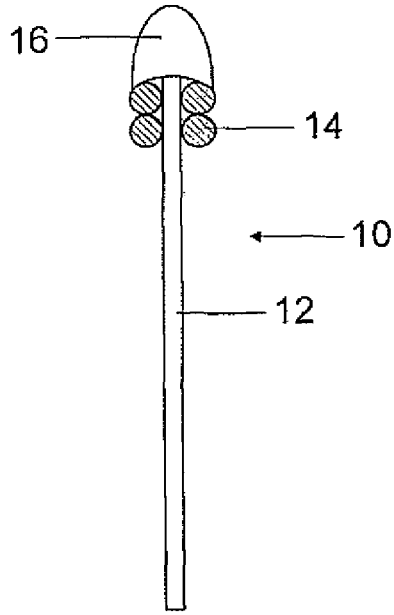

In the embodiment illustrated in FIG. 4 of an inventive electrode 10 the pin 12 does not extend into a front region 20 of the electrode coil 14 facing away from the pin. This region 20 facing away from the pin preferably is a quarter, even more preferably a third of the electrode coil 14. As emerges from a comparison of FIGS. 4*b* and 3*b*, the variant in FIG. 4 permits the formation of a larger compact thermal mass 16 without the portion of additives in this compact thermal mass 16 exceeding a definable threshold value.

If a definable threshold for the portion of the pin 12 in this compact thermal mass 16 is set, in order to keep the portion of additives below a determined value, it is obvious that in the variant according to FIG. 4 a larger compact thermal mass 16 can be created than with the variant in FIG. 3. The variant in FIG. 4 is hence characterized by even better maintenance.

The melting can for example be effected by arc discharge, electron beam, laser, plasma, etc.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. An electrode for a discharge lamp, wherein the electrode comprises a pin and a mass arranged on an end of the pin by melting over an electrode coil, wherein the pin consists of tungsten with microstructure-stabilizing additives, wherein the concentration of the microstructure-stabilizing additives is greater than or equal to 30 ppm, wherein the electrode coil consists of pure tungsten, which has additives at most up to a concentration of 20 ppm, and wherein the pin does not extend into the melt zone of the electrode coil.

2. The electrode as claimed in claim 1, wherein the concentration of the microstructure-stabilizing additives in the pin is greater than or equal to 60 ppm.

3. The electrode as claimed in claim 1, wherein the concentration of the additives in the electrode coil is less than or equal to 5 ppm.

4. The electrode as claimed in claim 1, wherein the pin extends into the melt zone of the electrode coil.

5. The electrode as claimed in claim 1, wherein the pin does not extend into a front region of the electrode coil facing away from the pin.

6. The electrode as claimed in claim 1, wherein the electrode coil comprises between 3 and 20 windings, wherein the pin at least does not extend into the front quarter facing away from the pin.

7. The electrode as claimed in claim 6, wherein the windings of the electrode coil are arranged at least in part in one layer.

8. The electrode coil as claimed in claim 6, wherein the windings of the electrode coil are arranged one above the other at least in part in at least two layers.

9. The electrode as claimed in claim 1, wherein the melting is designed such that a compact thermal mass is formed, wherein the portion of the pin in said compact thermal mass is less than or equal to 15%.

10. The electrode as claimed in claim 1, wherein the microstructure-stabilizing additives comprise potassium and/or thorium.

11. A discharge lamp with an electrode as claimed in claim 1.

12. The electrode as claimed in claim 1, wherein the concentration of the microstructure-stabilizing additives in the pin is greater than or equal to 80 ppm.

13. The electrode as claimed in claim 1 wherein the concentration of the additives in the electrode coil is less than or equal to 1 ppm.

14. The electrode as claimed in claim 1, wherein the electrode coil comprises between 3 and 20 windings, wherein the pin at least does not extend into the front third facing away from the pin of the windings.

15. The electrode as claimed in claim 1, wherein the melting is designed such that a compact thermal mass is formed, wherein the portion of the pin in said compact thermal mass is less than or equal to 1%.

16. An electrode for a discharge lamp, wherein the electrode comprises a pin and a mass arranged on an end of the pin by melting over an electrode coil, wherein the pin consists of tungsten with microstructure-stabilizing additives, wherein the concentration of the microstructure-stabilizing additives is greater than or equal to 30 ppm, wherein the electrode coil consists of pure tungsten, which has additives at most up to a concentration of 20 ppm, and wherein the pin does not extend into a front region of the electrode coil facing away from the pin.

17. An electrode for a discharge lamp, wherein the electrode comprises a pin and a mass arranged on an end of the pin by melting over an electrode coil, wherein the pin consists of tungsten with microstructure-stabilizing additives, wherein the concentration of the microstructure-stabilizing additives is greater than or equal to 30 ppm, wherein the electrode coil consists of pure tungsten, which has additives at most up to a concentration of 20 ppm, and wherein the electrode coil comprises between 3 and 20 windings, wherein the pin at least does not extend into the front quarter facing away from the pin.

* * * * *